US005123605A

United States Patent [19]

Hehner et al.

[11] Patent Number: 5,123,605

[45] Date of Patent: Jun. 23, 1992

[54] EXPANDING MECHANISM FOR TENSIONING AND POSITIONING REEL CORES

[75] Inventors: Reinhard Hehner, Haan; Hans-Dieter Olthaus, Düsseldorf, both of Fed. Rep. of Germany

[73] Assignee: Jagenberg Aktiengesellschaft, Dusseldorf, Fed. Rep. of Germany

[21] Appl. No.: 657,611

[22] Filed: Feb. 19, 1991

Related U.S. Application Data

[63] Continuation of Ser. No. 395,858, Aug. 18, 1989, abandoned.

[30] Foreign Application Priority Data

Sep. 1, 1988 [DE] Fed. Rep. of Germany ..... 3829704

[51] Int. Cl.[5] ..... B65H 75/18; B65H 19/02

[52] U.S. Cl. ..... 242/72 R; 242/68.3; 242/68.1

[58] Field of Search ..... 242/72, 72 R, 68.4, 242/68.3, 48.1, 72 B, 68.1

[56] References Cited

U.S. PATENT DOCUMENTS

| | | | |
|---|---|---|---|
| 1,673,444 | 2/1924 | Derry | 242/72 R |
| 1,876,490 | 12/1929 | Forbes | 242/72 R |
| 2,465,366 | 5/1945 | Frettoloso | 279/2 R |
| 2,733,022 | 7/1954 | Grody | 242/72 R |
| 2,894,757 | 10/1955 | Schustack | 279/2 R |
| 2,920,894 | 6/1956 | Kreinick | 279/2 R |
| 3,022,959 | 10/1957 | Blake | 279/2 R |
| 3,131,946 | 5/1964 | Newhouser | 279/2 R |
| 3,419,227 | 12/1966 | Werkmeister | 242/72 R |
| 3,768,749 | 10/1973 | Frederickson | 242/72 R |
| 4,058,268 | 11/1977 | Puccetti et al. | 242/72 R |
| 4,143,830 | 3/1979 | Dee | 242/72 R |
| 4,339,094 | 7/1982 | Thieuessen et al. | 242/72 R X |

FOREIGN PATENT DOCUMENTS

| | | | |
|---|---|---|---|
| 719592 | 10/1965 | Canada | 242/72 R |
| 0208832 | 1/1987 | European Pat. Off. . | |
| 1962449 | 7/1970 | Fed. Rep. of Germany . | |
| 1574438 | 10/1971 | Fed. Rep. of Germany . | |
| 2526497 | 11/1976 | Fed. Rep. of Germany . | |
| 2618652 | 11/1976 | Fed. Rep. of Germany . | |
| 355668 | 8/1961 | Switzerland . | |
| 778860 | 1/1979 | U.S.S.R. | 242/72 R |

*Primary Examiner*—Stuart S. Levy
*Assistant Examiner*—Joseph A. Rhoa
*Attorney, Agent, or Firm*—Sprung Horn Kramer & Woods

[57] ABSTRACT

A mechanism for tensioning and positioning reel cores, especially in machines for winding and unwinding webs of paper and cardboard, having a cylindrical eccentric tensioning component (10) that is mounted on a journal rigidly connected to a driveshaft or brake shaft, that expands radially when its circumference moves relative to the journal, and that interlocks with the core by way of elevations distributed around its outside circumference. A cylindrical positioning head with a smooth surface is concentrically connected to the driveshaft or brake shaft and is followed by the tensioning component. The diameter of the positioning head equals the inside diameter of the core. The tensioning component is axially shorter than the positioning head. The outside diameter of the unexpanded tensioning component is slightly longer than the outside diameter of the positioning head and is concentric with it.

2 Claims, 2 Drawing Sheets

EXPANDING MECHANISM FOR TENSIONING AND POSITIONING REEL CORES

This application is a continuation of application Ser. No. 395,858, filed Aug. 18, 1989 now abandoned.

BACKGROUND OF THE INVENTION

The invention concerns a mechanism for tensioning and positioning reel cores, especially in machines for winding and unwinding webs of paper and cardboard, with a cylindrical tensioning component that is mounted on a journal rigidly connected to a driveshaft or brake shaft, that expands radially when its circumference moves relative to the journal, and that interlocks with the core by way of elevations distributed around its outside circumference.

Many mechanisms for tensioning and positioning reel cores with a tensioning component mounted on a journal that is concentrically connected to a driveshaft or brake shaft and that expands radially when its circumference moves relative to the journal in order to tension the core are known. A generic mechanism is described for example in European C 0 208 832.

When heavy reels of paper are wound or unwound, the known tensioning mechanisms are very effective for positioning and securing the reels against the cores as long as the torque that occurs when the reel is braked or accelerated and that is to be transmitted increases with the weight of the reel. When on the other hand torque is to be avoided in a heavy reel (e.g. three metric tons), the known tensioning mechanisms have considerable drawbacks.

Since they cannot position the reel precisely until they have expanded, torque must be applied to attain the expansion, leading to a relative motion between the tensioning head and the reel, increasing the wear on the reel, and contaminating the measurement of speed of rotation by way of the journal. Furthermore, a tensioning head that employs spreading structures often exhibits out-of-control motion and load processes between the supporting journal and the structures that undergo the spreading, leading to severe enough wear to destroy the tensioning heads relatively early. Sealing out dust represents another problem in that the moving parts need to be lubricated.

OBJECT OF THE INVENTION

The object of the present invention is to improve the generic mechanism to the extent that the core will be reliably centered and positioned and will be subject to little wear even in the absence of torque.

This object is attained in accordance with the invention by the improvement wherein a cylindrical positioning head 7 with a smooth surface is concentrically connected to the driveshaft or brake shaft 1 and is followed by the tensioning component 10, wherein the diameter of the positioning head equals the inside diameter of the core, wherein the tensioning component is axially shorter than the positioning head, and wherein the outside diameter of the unexpanded tensioning component is slightly longer than the outside diameter of the positioning head and is concentric with it.

All that the tensioning component in the tensioning and positioning mechanism in accordance with the invention does is transmit torque. The weight of the reels is supported by the smooth and cylindrical positioning head, which also centers and positions the reels.

Since no torque is needed to position the reels and since there is accordingly no relative motion between the reel and the tensioning component, the tensioning and positioning mechanisms in accordance with the invention are also especially effective for directly measuring the speed of rotation of the reels in the absence of torque. Positioning and centering will be completely maintained even when one of the structures that transmits torque breaks down.

One embodiment of the invention has a resilient structure 15 that forces the tensioning component into a position wherein its outer diameter is concentric with the outside diameter of the positioning head. This characteristic makes it possible to reset the unloaded tensioning structure to accept a fresh core.

The tensioning component in another embodiment can be a hollow cylinder that has an eccentric inner opening with a circular cross-section and that is eccentrically mounted such that it can circumferentially rotate at least to some extent freely on a tappet 8 eccentrically secured to the positioning head.

The tensioning component in another embodiment can have, first, a positioning groove 13 that extends along a circular arc concentric to the tappet 8 and, second, a pin 12 that is secured to the positioning head, that extends into the positioning groove, and that is tensioned at each end between compression springs 15.

These two embodiments are simple in design and have components that are easy to maintain and subject to little wear.

The tensioning component, finally, can be slightly resilient radially. The advantage of this embodiment is that the core that is being tensioned is not displaced eccentric to the axis of rotation of the positioning head. The outer surface of the tensioning component is forced back by the weight of the roll, with none of the tensioning force wasted to transmit torque.

BRIEF DESCRIPTION OF THE DRAWINGS

One embodiment of the invention will now be described in detail with reference to simplified drawings, wherein.

DETAILED DESCRIPTION OF THE INVENTION

Figure 1:
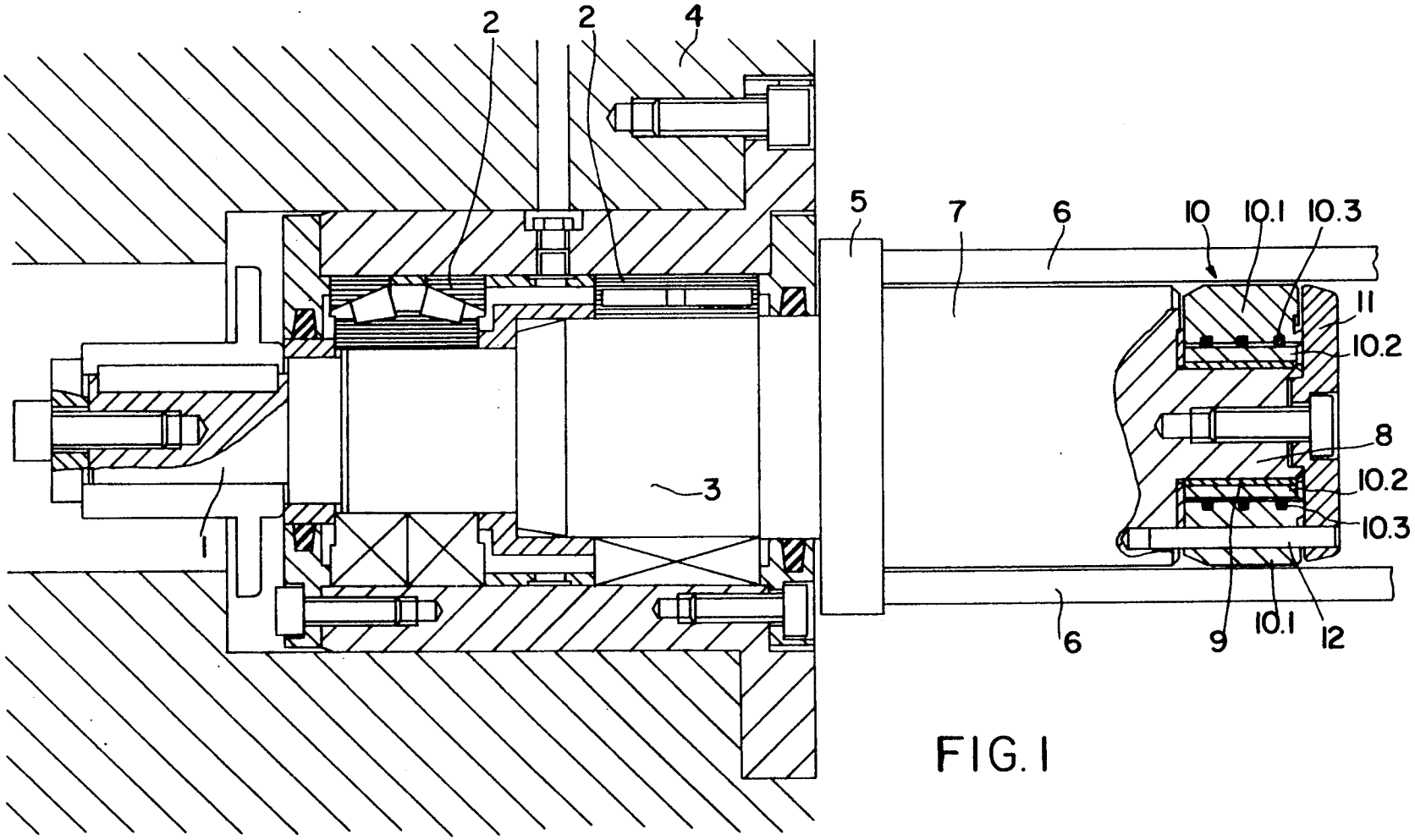
FIG. 1 is a partly sectional left side elevational view of a tensioning mechanism in accordance with the invention and FIG. 2 is a partly sectional top plan view.
Figure 2:
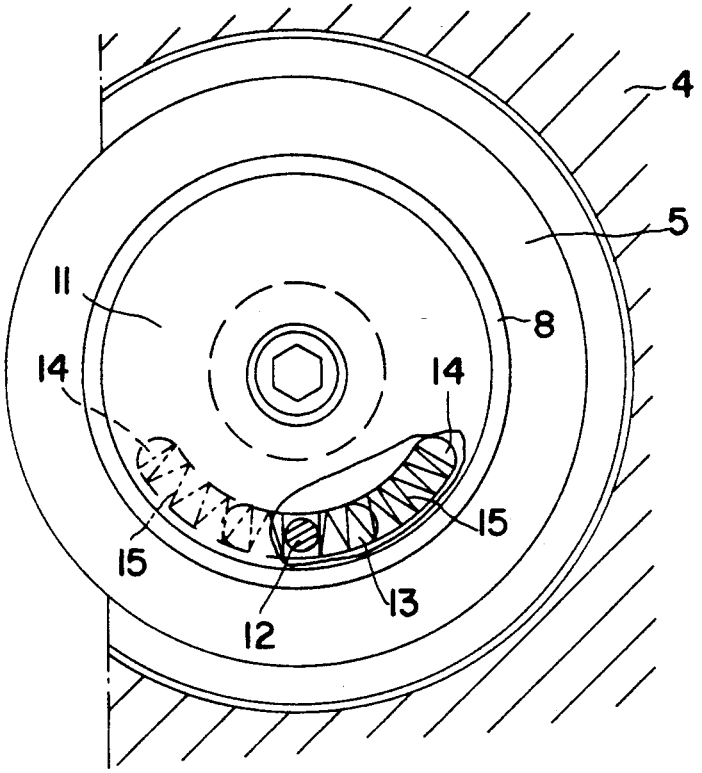

Tensioning mechanisms of this type are installed for example in the carriages of individual winding stations in conjunction with center-drum machines for winding webs of paper or cardboard on cores.

One tensioning head of the type in accordance with the invention enters each side of a core to secure and position the reel, and torque is transmitted to the core from time to time during the winding process in order to control reel density.

The tensioning mechanism has a shaft 1 that can be coupled to a drive mechanism with its mount 2 secured in the unillustrated carriage of a winding station. Secured concentric to driveshaft 1 is a journal 3 that is partly mounted in winding carriage 4. Mounted on the journal in the vicinity of the demarcating wall of winding carriage 4 is a flange-like stop 5 that acts on cores 6. The end of journal 3 next to stop 5 acts as a positioning head 7 for the cores. Positioning head 7 has a smooth surface and its diameter substantially equals the inside diameter of the cores, approximately 76 mm in the present case.

Secured approximately 3 mm eccentric on the end of positioning head 7 is a cylindrical tappet 8. Its diameter is about half that of the positioning head. Freely rotating on a bearing bush 9 on tappet 8 is hollow and cylindrical tensioning component 10 with a circular inner bore. Since tensioning component 10 is also mounted with the same eccentricity as that of the tappet, its surface will, when it is in its basic position, be concentric with the surface of the positioning head. In this basic position, the longest diameter of tensioning component 10 will be about 0.1 mm longer than that of positioning head 7, and, when a core 6 is positioned over it, the corrugated surface of the tensioning component will interlock with the inner surface of the core. A disk 11 with a diameter that is slightly shorter than the longest diameter of tensioning component 10 is screwed tight to the end of tappet 8 to secure the component against axial displacement.

Tensioning component 10 can be slightly compressed radially. The tensioning component in the illustrated embodiment consists for this purpose of two annular components 10.1 and 10.2 that are positioned concentrically one on top of the other in such a way that they cannot rotate in relation to each other and with a resilient layer 10.3 between them. Resilient layer 10.3 consists of two adjacent rubber 0 rings that allow a limited resilient displacement of outer component 10.1 toward inner component 10.2.

It is alternatively possible to employ a tensioning component that consists entirely or partly, at its outer zone for example, of a material of limited resilience.

To make it possible to adjust tensioning component 10 in its basic position, when it is not subject to load, to accept a fresh core 6, a pin 12 that is positioned off and parallel with the axis of rotation is secured to the face of positioning head 7. Pin 12 extends into a positioning groove 13 in tensioning component 10. Positioning groove 13 extends along the arc of a circle that is concentric with tappet 8. At each end it extends circumferentially into a shallower groove 14 that also accommodates a helical spring 15. Helical springs 15 force tensioning component 10 into the aforesaid basic position in the absence of torque. Their spring constant, however, is weak enough to prevent them from exerting much resistance to any rotary forces that occur.

The ratio of the axial length of positioning head 7 to that of tensioning component 10 is higher than 1:1 and slightly higher than 2:1 in the illustrated embodiment.

In the unloaded state, springs 15 force tensioning component 10 into a position concentric to positioning head 7, so that, when cores 6 are positioned on tensioning component 10, they interlock with its total circumference. When shaft 1 applies torque to tensioning component 10, its eccentric position forces it out, tensioning core 6 between the outwardly forced surface of component 10.1 and the facing circumferential section of positioning head 7. Core 6 is prevented from moving eccentrically because the layer 10.3 in tensioning component 10 is compressed against its resilient countervailing force, maintaining the tensioning force for transmitting the torque. Torque is transmitted from tappet 8 to tensioning component 10 because the latter is secured to tappet 8 due to the eccentricity.

The free eccentric position of tensioning component lo results in an equilibrium of forces between it and the inner surface of the core that always matches the driving torque. As the weight of the reel increases during the winding process, it is supported by positioning head 7, not by tensioning component 10. Since the reel is also centered by positioning head 7, tensioning component 10 only transmits torque.

The system is of particular advantage in conjunction with a core drive mechanism in a center-drum winder, wherein the tensioning mechanisms apply additional torque at the commencement of the winding process in order to control reel density. Once the reel has attained a specific weight, the drive mechanism is disengaged from the tensioning mechanisms, and the reels are driven by the center drum that rests against them from that moment on. The increasing reel weight (up to 6 metric tons) is supported only by the smooth positioning head 7, which is now idling and which also centers the reel. Tensioning component 10 follows unloaded, with no relative speed in relation to core 6. The following involves no friction between the corrugated surface of tensioning component 10 and the inner surface of the core because the tensioning component can, due to its mounting, which is eccentric and free within certain limits, avoid any circumferential forces. Any relative motion on the part of the tensioning component that derives from these forces will occur with low friction and only between bearing bush 9 and tappet 8. The bearing bushes are economical and maintenance-free frictional components that can rapidly be replaced when necessary.

Since no torque needs to be applied to secure and position core 6 and since no relative motion accordingly occurs between positioning head 7 and the core, a tensioning mechanism in accordance with the invention is also especially appropriate for the on-line measurement of core-rotation speed. The speed of rotation of the core can accordingly be accurately determined directly at shaft 1 with no need for expensive corrective measures, by affixing measuring labels to the cores for example. The tensioning mechanisms in accordance with the invention can accordingly also be employed to great advantage in winders wherein no additional torque is applied by way of shaft 1, drum winders for example.

Another significant advantage is that the tension mechanism is self-sealing and accordingly unaffected by dust.

It is understood that the specification and examples are illustrative but not limitative of the present invention and that other embodiments within the spirit and scope of the invention will suggest themselves to those skilled in the art.

What is claimed is:

1. A mechanism for tensioning and positioning reel cores in machines for winding and unwinding webs of paper and cardboard, including:

(a) a cylindrical core chuck (7) having a smooth outer surface which is mounted on a journal (3) rigidly connected to a driveshaft, that has an outside diameter substantially equal to the inside diameter of the reel core;

(b) a hollow cylindrical eccentric tensioning component (10), positioned immediately adjacent the chuck, that rests on an eccentric tappet (8) rigidly connected to the chuck, wherein the tensioning component radially expands in response to circumferential motion in relation to the tappet, wherein the tensioning component is circumferentially secured to the tappet (8), and wherein the axial length of each the tappet and the tensioning component is less than one half the axial length of the chuck;

(c) a bearing bushing (9) positioned between an outer circumference of said tappet and an inner circumference of said tensioning component, wherein said tensioning component (10) includes two annular components (10.1 and 10.2) with a resilient layer (10.3) therebetween; and wherein the tensioning component has an outside diameter that is slighter greater than the outside diameter of the chuck; and (d) a resilient structure which forces the tensioning component (10) into a position wherein its outside diameter is concentric with the outside diameter of the chuck, the tensioning component including an arcuate positioning groove (14) concentric to the tappet, a pin (12) which is fixed to the chuck and extends axially completely through the tensioning component (10), wherein the pin (12) extends into the positioning groove (14) and is tensioned between two helical compression springs.

2. A mechanism for tensioning and positioning reel cores according to claim 1, wherein the tensioning component is slightly resilient radially.

* * * * *

UNITED STATES PATENT AND TRADEMARK OFFICE

CERTIFICATE OF CORRECTION

PATENT NO. : 5,123,605

DATED : June 23, 1992

INVENTOR(S) : Hehner et al.

It is certified that error appears in the above-identified patent and that said Letters Patent is hereby corrected as shown below:

Title Page item [56] U.S. PATENT DOCUMENTS: After " 1,673,444 " delete " 2/1924 " and substitute -- 6/1928 --; after " 1,876,490 " delete " 12/1929 " and substitute -- 9/1932 --; after "2,465,366 " delete " 5/1945 " and substitute -- 3/1949 --; after " 2,733, 022 " delete " 7/1954 " and substitute -- 1/1956 --; after " 2,894,757 " delete " 10/1955 " and substitute -- 7/1959 --; after " 2,920,894 " delete " 6/1956 " and substitute -- 1/1960 --; after " 3,022,959 " delete " 10/1957 " and substitute 2/1962 --; after " 3,419,227 " delete " 12/1966 " and substitute -- 12/1968 --.

Signed and Sealed this

Twenty-first Day of December, 1993

Bruce Lehman

*Attest:*

BRUCE LEHMAN

*Attesting Officer*

*Commissioner of Patents and Trademarks*